United States Patent [19]

Wochnowski

[11] Patent Number: 4,489,737

[45] Date of Patent: Dec. 25, 1984

[54] METHOD AND APPARATUS FOR REDUCING THE MOISTURE CONTENT OF TOBACCO

[75] Inventor: Waldemar Wochnowski, Hamburg-Melendorf, Fed. Rep. of Germany

[73] Assignee: Hauni-Werke Körber & Co. KG, Hamburg, Fed. Rep. of Germany

[21] Appl. No.: 335,655

[22] Filed: Dec. 30, 1981

Related U.S. Application Data

[63] Continuation of Ser. No. 123,020, Feb. 20, 1980, abandoned, which is a continuation of Ser. No. 781,330, Mar. 25, 1977, abandoned, which is a continuation of Ser. No. 588,169, Jun. 18, 1975, abandoned.

[30] Foreign Application Priority Data

Jul. 9, 1974 [DE] Fed. Rep. of Germany ..... 2432848

[51] Int. Cl.[3] ..... A24B 3/12; A24B 3/10; A24B 3/18

[52] U.S. Cl. ..... 131/302; 131/303; 131/304; 131/305

[58] Field of Search ..... 131/302, 303, 304, 305; 34/56, 52, 44, 46, 48, 50

[56] References Cited

U.S. PATENT DOCUMENTS

| | | | |
|---|---|---|---|
| 3,372,488 | 3/1968 | Koch et al. | 131/302 |
| 3,396,476 | 8/1968 | Eaves | 131/304 |
| 3,502,085 | 3/1970 | Wochnowski | 131/305 |
| 3,760,816 | 9/1973 | Wochnowski | 131/302 |
| 3,794,049 | 2/1974 | Wochnowski | 131/303 |
| 3,840,025 | 10/1974 | Fawler | 131/305 |
| 4,255,869 | 3/1981 | Quester et al. | 34/25 |

OTHER PUBLICATIONS

"Feuchtigkeit", Grundlagen Messen-Regeln mit 201 Abbildungen und 41 Tafeln, R. Oldenbourg, Munchen, Wien 1964.

*Primary Examiner*—V. Millin

*Attorney, Agent, or Firm*—Peter K. Kontler

[57] ABSTRACT

Particles of tobacco which form a continuous stream are heated during transport through a rotary drum-shaped dryer. The inlet end of the dryer receives a continuous current of heated air whose temperature is constant, and the dryer is heated by internal coils for circulating steam whose pressure is constant. The quantity of tobacco particles in the stream is varied in dependency on deviations of measured final moisture content from a desired final moisture content and/or in dependency on deviations of measured initial moisture content from anticipated initial moisture content.

24 Claims, 1 Drawing Figure

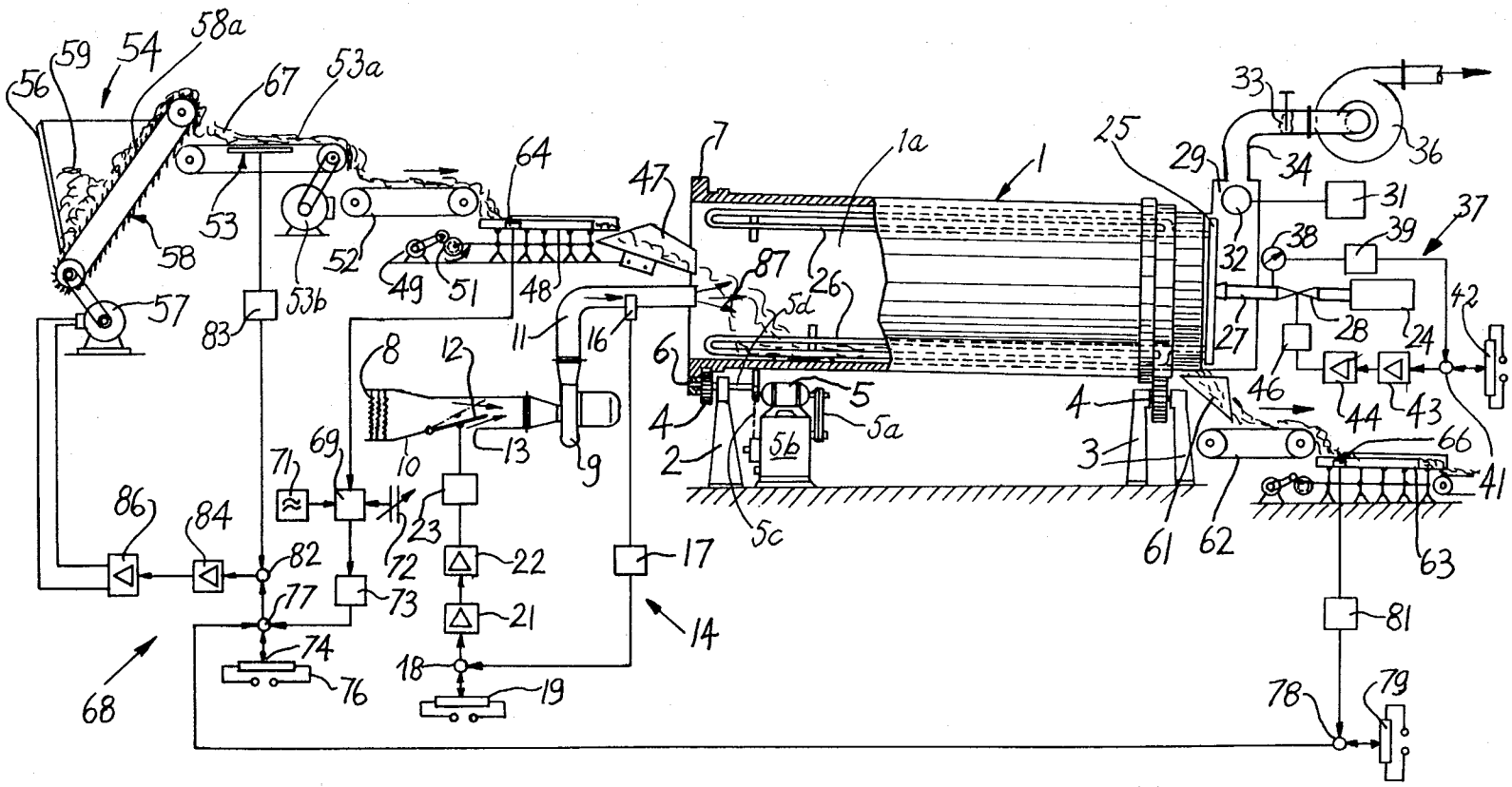

METHOD AND APPARATUS FOR REDUCING THE MOISTURE CONTENT OF TOBACCO

CROSS-REFERENCE TO EARLIER APPLICATIONS

This application is a continuation of Ser. No. 123,020 filed Feb. 20, 1980 now abandoned. The application Ser. No. 123,020 is a continuation of Ser. No. 781,330 filed Mar. 25, 1977 and now abandoned. The application Ser. No. 781,330 is a continuation of Ser. No. 588,169 filed June 18, 1975 and now abandoned.

BACKGROUND OF THE INVENTION

The present invention relates to conditioning of tobacco, and more particularly to improvements in a method and apparatus for reducing the moisture content of tobacco. Still more particularly, the invention relates to a method and apparatus for reducing the moisture content of tobacco particles which are transported in the form of a continuous stream.

It is necessary to reduce the moisture content of tobacco leaves or shreds prior to conversion of dried tobacco into the fillers of cigarettes, cigars or other rod-shaped smokers' products. As a rule, the final moisture content of tobacco should coincide with or deviate only negligibly from a preselected final moisture content because any appreciable deviation from such preselected moisture content affects the quality of ultimate product and/or involves additional expenses to the manufacturer. For example, the weight of a cigarette must match or exceed a prescribed minimum weight and, therefore, if the particles of tobacco which form the fillers of cigarettes are too dry, the quantity of tobacco in such cigarettes must be increased with resulting losses to the manufacturer. Such losses can be avoided if the shreads which are to be converted into the filler of a cigarette rod are dried in such a way that their moisture content equals or closely approximates a preselected final moisture content.

U.S. Pat. No. 3,372,488 discloses a tobacco drying apparatus wherein a continuous stream of moist tobacco is conveyed through a conditioning chamber which is defined by a rotary drum and wherein tobacco exchanges heat with a fluid. The quantity of heat which is supplied by the fluid varies in dependency on changes in the initial moisture content of tobacco. The fluid is usually heated air. A drawback of such apparatus is that it must be equipped with means for heating large quantities of air so as to be capable of properly drying tobacco having a relatively high or relatively low moisture content. When the initial moisture content of tobacco is low, the flow of heated air is throttled to prevent excessive drying of tobacco; on the other hand, the quantity of heated air which contacts the particles of tobacco in the rotating drum is increased when the initial moisture content of tobacco is higher. Such mode of operation necessitates the heating of excessive quantities of air. Moreover, certain types of tobacco, or tobacco particles which underwent a special preliminary treatment (e.g., tobacco containing large quantities of casing), should not be contacted with substantial quantities of air. In order to avoid undesirable reactions, such types of tobacco must be dried with relatively small quantities of air which, in accordance with presently known methods, results in relatively low output of the apparatus. The situation is similar when the heating fluid is conveyed countercurrent to the direction of movement of tobacco particles through the conditioning chamber. The apparatus must produce relatively large quantities of heated fluid because the initial moisture content and/or quantity of tobacco varies, often within an extremely wide range.

OBJECTS AND SUMMARY OF THE INVENTION

An object of the invention is to provide a novel and improved method of reducing the moisture content of tobacco without any or with minimal losses in heat energy.

Another object of the invention is to provide a method which can be resorted to for proper drying of tobacco particles whose initial moisture content fluctuates within a wide range in spite of the fact that the quantity of heating medium or media need not be varied in response to fluctuations of initial moisture content of tobacco.

A further object of the invention is to provide an apparatus which can be used for the practice of the just outlined method and whose energy requirements are lower than those of pesently known apparatus for reducing the moisture content of tobacco to a preselected final value.

An additional object of the invention is to provide a tobacco drying apparatus which, in spite of its low energy requirements, can reduce the moisture content of tobacco to a preselected value even if the initial moisture content of tobacco fluctuates within a wide range.

A further object of the invention is to provide the apparatus with novel and improved means for maintaining an optimum ratio between the heat energy input, the quantity of tobacco which is being treated per unit of time, and the initial moisture content of tobacco.

The method of the present invention comprises the steps of conveying a continuous stream of tobacco particles (e.g., tobacco leaves or tobacco shreds) along a predetermined path (such path can be defined by several conveyers including a rotary drum which defines a tobacco conditioning chamber or zone), supplying to tobacco in a portion of such path (preferably in the aforementioned conditioning chamber) a constant quantity of heat energy so that the particles of tobacco undergo a heating action with attendant reduction of their moisture content, measuring the initial moisture content of tobacco upstream of the conditioning chamber, and changing the quantity of tobacco in the stream as a function of changes in initial moisture content so that the final moisture content of tobacco downstream of the conditioning chamber at least approximates a preselected final moisture content.

The changing step may comprise comparing the measured initial moisture content with a predetermined or anticipated initial moisture content, and changing the quantity of tobacco in the stream when the measured initial moisture content deviates from the predetermined initial moisture content. The quantity of tobacco in the stream will be increased when the measured initial moisture content is less than the predetermined initial moisture content, and the quantity of tobacco in the stream will be reduced when the measured initial moisture content exceeds the predetermined initial moisture content.

The method may further comprise the steps of measuring the final moisture content of tobacco downstream of the conditioning chamber, and changing the quantity of tobacco in the stream when the measured final moisture content deviates from a preselected or desired final moisture content.

The supplying step may comprise conveying successive increments of the tobacco stream across a current of heated gaseous fluid (e.g., air) whose temperature is maintained at a substantially constant value. The supplying step may further comprise conveying the gaseous fluid in the conditioning chamber concurrent with the tobacco stream. Also, the supplying step may comprise indirectly heating tobacco in the conditioning chamber with a second heated fluid (preferably with steam whose pressure is maintained at a preselected value).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a diagrammatic partly elevational and partly sectional view of an apparatus which embodies and form of the invention.

DESCRIPTION OF THE PREFERRED EMBODIMENTS

The apparatus which is illustrated in the drawing comprise a conveyor here shown as a rotary drum-shaped dryer 1 which is open at both ends and defines an elongated conditioning chamber is wherein a continuous stream 67 of tobacco particles advances in a direction from the left to the right, as viewed in the drawing. The dryer 1 has a slight downward inclination in the direction of tobacco transport. The inlet and discharge ends of the dryer 1 are respectively supported by and rotate relative to upright brackets 2 and 3 which carry idler rolls 4 engaging the adjacent portions of the peripheral surface of the dryer. The means for rotating the dryer 1 about its axis comprises a driver gear 6 which meshes with a ring gear 7 surrounding the inlet end of the dryer, and which receives torque from a prime mover including an electric motor 5, a first belt or chain drive **5*a* which receives motion from the motor 5, a variable-speed transmission 5*b* whose input element is rotated by the drive 5*a* and whose output element transmits motion to a second belt or chain drive 5*c*, and a shaft 5*d* which is rotated by the drive 5*c* and is rigid with the gear 6**.

Successive increments of the stream 67 which enter the inlet end of the dryer 1 are traversed by one or more jets 87 of a first fluid (preferably heated air) which is supplied by a pipe 11 connected to the outlet of a motor-driven fan 9. The latter draws atmospheric air through the open left-hand end of a suction pipe 10 containing an electric resistance heater 8 and having an opening 13 for admission of unheated (cool) atmospheric air downstream of the heater 8. The effective size of the opening 13 is controlled by a valve here shown as a flap 12 which is pivotably mounted in the suction pipe 10 and can be moved to and from a plurality of different positions by a reversible motor 23. The motor 23 can change the position of the valve 12 in such a way that the latter reduces the rate of inflow of cold air when it increases the rate of inflow of heated air, and vice versa. Cold air and heated air are thoroughly intermixed with each other not later than in the supply pipe 11 so that the temperature of air contacting successive increments of the tobacco stream 67 can be monitored with a high degree of accuracy by a detector 16 which, together with the motor 23, forms part of a first control circuit 14. The purpose of the control circuit 14 is to maintain the temperature of air at the outlet end of the supply pipe 11 at a constant or substantially constant value. Such air forms a current which flows in the chamber is toward and into a hood 29. The detector 16 (e.g., a suitable thermometer) is mounted in or close to the outlet end of the supply pipe 11 and transmits signals to a transducer 17 whose output is connected to one input of a signal comparing junction 18. The latter has another input which is connected to a rated value selector 19 (e.g., an adjustable potentiometer). When the intensity of electric signals furnished by the transducer 17 deviates from the intensity of electric signals supplied by the selector 19, the output of the junction 18 transmits an appropriate signal to the motor 23 through the medium of a preamplifier 21 and an operational amplifier 22 whereby the motor 23 pivots the valve 12 clockwise or counterclockwise, depending upon whether the measured temperature of air in the supply pipe 11 is less than or exceeds the temperature corresponding to that which is indicated by the intensity of signals furnished by the selector 19.

The conditioning chamber is in the dryer 1 contains several longitudinally extending coils 26 for a second fluid (preferably steam). The coils 26 rotate with the dryer 1 so that the latter is indirectly heated by circulating steam. In addition, the cells 26 heat the particles of tobacco in the chamber **1*a* and act not unlike paddles or vanes which agitate the particles of tobacco by entraining them from the lowermost portion of the chamber 1*a* and by thereupon permitting the entrained particles to descend by gravity into the path of oncoming coils. The coils 26 receive fresh steam from a distributor 25 which is adjacent to the discharge end of the dryer 1 and is connected with a suitable source 24 (e.g., a steam generator) by a steam pipe 27 containing a regulating valve 28. The arrangement is preferably such that the pipe 27 comprises an inner tube which supplies fresh steam to the distributor 25 and an outer tube or jacket which feeds spent steam from the distributor 25 to the source 24. The hood 29 seals the major part of the discharge end of the dryer 1 and is connected to a blower 36 by means of a suction pipe 34 containing an adjustable valve 33 and serving to withdraw air and vapors from the conditioning chamber 1*a*. The hood 29 contains a cylindrical sieve or filter 32 which is driven by a motor 31 and prevents the particles of tobacco from entering the suction pipe 34**.

The pressure of steam in the coils 26 is maintained at a constant or substantially constant value by a second control circuit 37 which includes a pressure gauge 38 connected with the inner tube of the steam pipe 27 and with a transducer 39 which transmits electric signals (whose intensity is indicative of steam pressure in the inner tube of the steam pipe 27) to a signal comparing junction 41. The latter is further connected with a rated value selector 42 (e.g., an adjustable potentiometer) and its output can transmit signals to an adjusting motor 46 for the regulating valve 28 through the medium of a preamplifier 43 and an operational amplifier 44. The motor 46 receives a signal when the measured steam pressure (gauge 38) deviates from the selected pressure (selector 42).

The steam 67 of tobacco particles is formed by a carded belt conveyor 58 which has an upwadly moving reach or stretch 58*e* constituting the mobile wall of a funnel-shaped magazine or hopper 54 for a supply 59 of tobacco particles. The magazine 54 further comprises a fixed wall 56 and suitable upper and lower level detectors (preferably photoelectric cells, not shown) which regulate the feed of tobacco particles into the magazine 54 so that the upper level of the supply 59 therein fluctuates very little or not at all. The means for feeding tobacco to the magazine 54 may comprise a pneumatic conveyor, a carded belt conveyor or the like.

The tobacco stream 67 which is being formed by the belt conveyor 58 travels with the upper reach of a belt conveyor 53*a* forming part of a weighing device 53. The belt conveyor 53*a* is driven at a constant speed by a motor 53*b*. The particles of tobacco which advance beyond the belt conveyor 53*a* are entrained and transported by the upper reach of an intermediate belt conveyor 52 which discharges tobacco into the trough of a vibratory conveyor 48. The trough of the conveyor 48 is vibrated by an electric motor 49 through the medium of an eccentric drive 51. The discharge end of the vibrating trough of the conveyor 46 feeds tobacco into a downwardly inclined chute 47 extending into the inlet end of the dryer 1.

Conditioned tobacco which issues from the dryer 1 descends in a chute 61 which feeds such tobacco to the upper reach of a belt conveyor 62. The latter feeds conditioned tobacco to the trough of a vibratory conveyor 63 which is analogous to or identical with the conveyor 48.

The weighing device 53 measures the throughput of tobacco (e.g., in kilograms per hour) and transmits corresponding signals to a transducer 83 forming part of a third control circuit 68. This control circuit changes the throughput of tobacco per unit of time (i.e., it varies the quantity of tobacco in the stream 67) when the initial final moisture content of tobacco deviates from a predetermined or anticipated initial and/or and/or a preselected or desired final moisture content. The control circuit 68 can change the throughput of tobacco by changing the speed of a motor 57 which drives the carded belt conveyor 58 of the magazine 54.

The initial moisture content of tobacco is monitored by a first detector 64 which is mounted in the trough of the vibratory conveyor 48, and the final moisture content of tobacco is monitored by a second detector 36 in the trough of the vibratory conveyor 63. The moisture detectors 64, 66 are preferably of the type disclosed in U.S. Pat. No. 3,372,488 to which reference may be had, if necessary. Such high-frequency detectors determine the moisture content in percent by weight.

It is especially important to change the throughput of tobacco (by motor 57) in response to each change in initial moisture content (as measured by the detector 64). The detector 64 transmits signals to an oscillator circuit 69 which is further connected with a high-frequency generator 71 and whose frequency is varied by a predetermined value (the so-called resonance point) by a frequency selector here shown as a variable capacitor 72 with a periodically varying capacity. The amplitude of the high-frequency oscillator circuit 69 is influenced by the capacity of a condenser which forms part of the detector 64 and is described and shown in U.S. Pat. No. 3,372,488. The capacity of the capacitor in the detector 64 depends on the moisture content of tobacco in the trough of the vibratory conveyer 48. The amplitude is measured by a transducer here shown as a peak voltmeter 73 which transmits signals having an intensity indicative of the moisture content of the respective increments of tobacco in the range of the detector 64. The output of the voltmeter 73 is connected with one input of a junction 77 having a second input which is connected to the sliding contact 74 of an adjustable potentiometer 76 constituting a rated value selector for the (anticipated) initial moisture content of tobacco.

The junction 77 has a third input which is connected to the output of a further junction 78 which is connected with the moisture detector 66 (by way of a transducer 81) and with a rated value selector 79 (e.g., an adjustable potentiometer) for the (desired) final moisture content of tobacco. The junction 78 transmits to the junction 77 a signal when the final moisture content of tobacco deviates from a desired or preselected final moisture content, and the output of the junction 77 transmits a signal to a junction 82 when the initial and/or final moisture content of tobacco deviates from that represented by the intensity of signals from the selector 76 and/or 79. The junction 82 is further connected with the weighing device 53 via transducer 83, and its output transmits signals to the meter 57 through the medium of a preamplifier 84 and an operational amplifier 86. The intensity of signal from the transducer 83 varies as a function of the changes in throughput of tobacco; the speed of the motor 57 changes whenever the intensity of signal from transducer 83 to junction 82 deviates from the intensity of signal which the junction 82 receives from the junction 77.

The operation:

The motor 57 drives the conveyor 58 so that the reach 58*a* draws a continuous stream 67 of tobacco particles (e.g., tobacco shreds) from the supply 59 and dumps the thus withdrawn material onto the belt conveyor 53*a* of the weighing device 53. Successive increments of the stream 67 are thereupon transported by the conveyor 52, and the trough of the conveyor 48 and enter the chute 47 prior to moving across the jets 87 of heated air issuing from the supply pipe 11. The jets 87 heat the tobacco particles and remove moisture therefrom not only at the inlet end of the continuously rotating dryer 1 but also while the thus formed current of heated air flows through the conditioning chamber 1*a* (concurrent with tobacco particles) on its way toward and into the hood 29. The quantity of heated air which enters the chamber 1*a* per unit of time is constant, and the temperature of such air is also constant or substantially constant as a result of the regulating action of control circuit 14. The detector 16 monitors the temperature of air in the pipe 11 and causes the transducer 17 to transmit to the junction 18 signals whose intensity is indicative of the temperature of air which is about to form the jets 87. The junction 18 compares such signals with those transmitted by the selector 19 and transmits a signal whenever the intensity of signals from 17 deviates from that of signals from 19. The motor 23 then changes the angular position of the valve 12 so that the ratio of heated air (heater 8) to unheated air (opening 13) in the pipe 10 changes but the total amount of air entering the supply pipe 11 remains constant. The (positive or negative) sign of the signal from junction 18 determines the direction of angular movement of the valve 12.

Tobacco particles which advance through the chamber 1*a* are also heated by the coils 26 and dryer 1 (i.e., by steam which is caused to circulate in the coils 26). The quantity of heat energy which the circulating steam exchanges with tobacco in the chamber 1*a* is substantially constant because the gauge 38 measures the pressure of fresh steam in the pipe 27 and transmits signals to the junction 41 by way of transducer 39. If the intensity of electric signals furnished by the transducer 39 deviates from that of signals supplied by the selector 42, the junction 41 transmits a signal which causes the motor 46 to adjust the valve 28. The sign of the signal furnished by the junction 41 determines whether the valve 28 increases or reduces the rate of steam flow through the coils 26.

The control circuit 68 regulates the quantity of tobacco particles in the stream 67 in the following way:

The detector 64 monitors the initial moisture content of tobacco in the trough of the conveyor 48. The amplitude of oscillations of the circuit 69 depends from the measured moisture content. Upon rectification, the right-hand input of the junction 77 receives d-c signals whose intensity is indicative of the moisture content of the respective increments of the stream 67. Such signals are compared with those furnished by the selector 76, and the lower input of the junction 82 receives a signal whenever the measured initial moisture content deviates from the anticipated initial moisture content. The intensity of signal from the junction 77 to junction 82 is indicative of the desired quantity or weight of tobacco particles per unit length of the stream 67. Such signal is compared with the signal from transducer 83 which is indicative of the measured quantity of tobacco particles per unit length of the stream. The sign of the signal from the junction 82 to the motor 57 determines whether the speed of the belt conveyor 58 increases or decreases. The motor 57 begins to drive the conveyor 58 at a newly constant speed as seen as the intensity of signal from 83 to 82 matches the intensity of signal from 77 to 82. The quantity of tobacco particles which the conveyor 58 supplies to the conveyor 53*a* (while the quantity of heat energy supplied by the jets 87 and steam in the coils 26 remains constant) can be expressed as follows:

$$G_t = \frac{Q \cdot (100 - fe)}{\mu_{verd.} \cdot (fa - fe) + C_t \Delta T_t (100 - fe)} \text{ [kg/h]}$$

wherein fa is the initial moisture content of tobacco (in percent), fe is the final moisture content of tobacco (in percent), $C_t$ is the quantity of tobacco in kilograms per hour, $\mu$ verd. is the evaporation and adsorpton heat in kcal/kg, $\Delta T_t$ is the difference between the temperature of tobacco at the inlet and discharge ends of the dryer 1 in °C., and $C_t$ is the specific heat of tobacco (in kcal/kg °C.).

It will be noted that the quantity of tobacco which is being conveyed through the dryer 1 fluctuates as a function of fluctuations is initial moisture content (fa). The conditioned tobacco leaves the chamber 1*a* to enter the chute 61 and to be transported to a further processing station via conveyors 62 and 63. The detector 66 measures the final moisture content (fe) and the junction 78 transmits to the junction 77 a signal when the measured final moisture content deviates from the desired final moisture content (selector 79). The intensity of signal from junction 77 to junction 82 is then modified accordingly so that the speed of the motor 57 increases or decreases until the measured final moisture content increases or decreases so that it ultimately matches that selected by 79.

The adjustments of motor 57 in response to signals from junction 78 to junction 77 are desirable in order to insure that the quantity of tobacco which forms the stream 67 is varied in response to short-range or long-range changes in all such parameters which influence the drying of tobacco in the chamber 1*a*. The apparatus can operate properly with a single heated fluid, e.g., with heated air supplied by the pipe 11. It will be noted that the first fluid flows in the chamber 1*a* concurrent with the tobacco stream 67 and that fresh second fluid (steam) flows in the chamber 1*a* countercurrent to the tobacco stream. Such mode of conveying the fluids brings about additional savings in heat energy. The control circuits 14 and 37 constitute optional but highly desirable features of the apparatus. For example, the control circuit 14 can be omitted and the valve 12 omitted or held in a fixed position if the heater 8 can cooperate with the fan 9 to supply into the chamber 1*a* a current of air whose temperature is practically constant.

An important advantage of the improved method and apparatus is that the measured final moisture content matches the desired or preselected final moisture content even if the initial moisture content fluctuates within a wide range and in spite of the fact that the quantity of energy which the fluid media exchange with tobacco remains constant. Thus, the final moisture content will match a desired moisture content even if the quantity of heat energy is constant and even if the available quantity of heat energy is very small; the quantity of tobacco per unit length of the stream is then reduced accordingly. The quantity of tobacco which is being processed per unit of time can be selected practically at will by appropriate adjustment of selector 19 and/or 42, i.e., by arbitrarily changing the total amount of heat energy which the tobacco exchanges with air supplied by the pipe 11 and with steam supplied by the pipe 27.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A method of reducing the moisture content of tobacco, comprising the steps of conveying along a predetermined path a continuous stream of moist tobacco having a varying initial moisture content; supplying to the tobacco a constant quantity of heat energy in a predetermined portion of said path so that the tobacco undergoes a heating action with attendant reduction of its moisture content; continuously measuring said initial moisture content of tobacco upstream of said portion of said path; and changing the quantity of tobacco in said stream as a function of variations of initial moisture content so as to maintain the final moisture content of tobacco downstream of said portion of said path at an at least substantially constant value irrespective of variations of said initial moisture content and in spite of the constancy of said supply of heat energy wherein the method further includes the step of measuring said final moisture content of tobacco downstream of said portion of said path and changing the quantity of tobacco in the stream upstream of said portion of said path when the measured final moisture content deviates from said constant value, the quantity of tobacco in said stream being equal to $$G_t = \frac{Q \cdot (100 - fe)}{\mu_{verd.} \cdot (fa - fe) + C_t \Delta T_t (100 - fe)} \text{ kg/h}$$

wherein fa and fe respectively denote the initial and final moisture content in percent, $\mu_{verd.}$ is the evaporation and adsorption heat in kcal/kg, $\Delta T_t$ is the difference between the temperatures at the inlet and discharge ends of said portion of said path in °C., $G_t$ is the quantity of tobacco in kg/h, and Q is said constant quantity of heat energy.

2. The method of claim 1, further comprising the steps of generating first signals denoting the measured initial moisture content of successive increments of the moist tobacco stream, monitoring the quantity of tobacco in successive increments of the stream, generating second signals denoting the quantity of tobacco in successive increments of the stream, and comparing said first signals with the corresponding second signals, said changing step comprising changing the quantity of tobacco in said stream when the characteristics of said first signals deviate from the characteristics of the corresponding second signals.

3. The method of claim 2, wherein said monitoring step comprises weighing successive increments of the tobacco stream.

4. The method of claim 1, wherein said supplying step comprises contacting the stream in said portion of said path with at least one heated surface and maintaining the temperature of such surface at a predetermined constant value.

5. The method of claim 1, wherein said supplying step comprises directly contacting the tobacco in said portion of said path with a heated gaseous fluid.

6. The method of claim 1, wherein said supplying step comprises contacting the stream in said portion of said path with at least one heated surface, maintaining the temperature of such surface at a predetermined constant value, directly contacting the tobacco in said portion of said path with a heated gaseous fluid, conveying such fluid to said portion of said path at a constant rate, and maintaining the temperature of conveyed fluid at a constant value.

7. The method of claim 1, further comprising the steps of monitoring the quantity of heat energy which is supplied to said portion of said path, generating a first signal denoting the monitored quantity of heat energy, generating a second signal denoting the desired quantity of heat energy, comparing said first and second signals, and changing the quantity of heat energy when said first signal deviates from said second signal.

8. The method of claim 1, further comprising the steps of monitoring said final moisture content and comparing the monitored final moisture content with said constant value, said changing step further comprising changing the quantity of tobacco in said stream ahead of said portion of said path when the monitored final moisture content deviates from said constant value.

9. Apparatus for reducing the moisture content of tobacco, comprising means for transporting a continuous stream of moist tobacco along a predetermined path; means for supplying to the tobacco a constant quantity of heat energy in a first portion of said path so that the tobacco undergoes a heating action with attendant reduction of its moisture content; detector means arranged to continuously measure the moisture content of tobacco in a second portion of said path; and means for varying the quantity of tobacco in the stream ahead of said first portion of said path when the measured moisture content deviates from a predetermined value so as to maintain the moisture content of tobacco downstream of said first portion of said path at an at least substantially constant value irrespective of variations of said initial moisture content and in spite of the constancy of the quantity of heat energy which is supplied to said first portion of said path wherein the quantity of tobacco in said stream equals $$G_t = \frac{Q \cdot (100 - fe)}{\mu_{verd.} \cdot (fa - fe) + C_t \Delta T_t (100 - fe)} \text{ kg/h}$$

wherein fa and fe respectively denote the initial and final moisture content in percent, $\mu_{verd.}$ is the evaporation and adsorption heat in kcal/kg, $\Delta T_t$ is the difference between the temperatures at the inlet and discharge ends of said first portion of said path in °C., $G_t$ is the quantity of tobacco in kg/h, and Q is said constant quantity of heat energy.

10. The apparatus of claim 9, wherein said transporting means is arranged to advance the tobacco stream in a predetermined direction and said second portion of said path is located upstream of said first portion, as considered in said direction, so that said detector means measures the initial moisture content of the stream.

11. The apparatus of claim 9, wherein said transporting means is arranged to advance the tobacco stream in a predetermined direction and said second portion of said path is located upstream of said first portion, as considered in said direction.

12. The apparatus of claim 9, wherein said transporting means is arranged to advance the stream in a predetermined direction and said second portion of said path is located upstream of said first portion, as considered in said direction, so that said detector means measures the initial moisture content of tobacco, said varying means comprising means for ascertaining the quantity of tobacco in the stream ahead of said first portion of said path, means for comparing the thus ascertained quantity with a preselected quantity, and means for changing the rate of transport of tobacco along said path when the ascertained quantity deviates from said preselected quantity.

13. The apparatus of claim 12, wherein said ascertaining means comprises a weighing device.

14. The apparatus of claim 9, wherein said supplying means comprises conveyor means having wall means and means for heating said wall means.

15. The apparatus of claim 14, wherein said supplying means further comprises means for directly contacting the tobacco in said first portion of said path with a gaseous heating fluid.

16. The apparatus of claim 14, wherein said transporting means is arranged to advance the tobacco stream in a predetermined direction and said second portion of said path is located upstream of said first portion, as considered in said direction, so that said detector means measures the initial moisture content of tobacco.

17. The apparatus of claim 14, wherein said varying means comprises means for ascertaining the quantity of tobacco in the stream ahead of said first portion of said path, means for comparing the thus ascertained quantity with a preselected quantity, and means for changing the rate of transport of tobacco along said path when the ascertained quantity deviates from said preselected quantity.

18. The apparatus of claim 17, wherein said ascertaining means comprises a weighing device.

19. The apparatus of claim 9, wherein said supplying means comprises conveyor means having wall means, means for heating said wall means, and means for directly contacting the tobacco in said first portion of said path with a hot gaseous fluid.

20. The apparatus of claim 19, wherein said transporting means is arranged to advance the tobacco stream in a predetermined direction and said second portion of said path is located upstream of said first portion, as considered in said direction, so that said detector means measures the initial moisture content of the stream.

21. The apparatus of claim 19, wherein said varying means comprises means for ascertaining the quantity of tobacco in the stream ahead of said first portion of said path, means for comparing the thus ascertained quantity with a preselected quantity, and means for changing the rate of transport of tobacco along said path when the ascertained quantity deviates from said preselected quantity.

22. The apparatus of claim 21, wherein said ascertaining means comprises a weighing device.

23. The apparatus of claim 9, wherein said second portion of said path is located downstream of said first portion, as considered in the direction of transport of tobacco along said path, so that said detector means measures the final moisture content of tobacco.

24. The apparatus of claim 23, wherein said detector means further comprises means for measuring the initial moisture content of tobacco upstream of said first portion of said path, said varying means comprising means for ascertaining the quantity of tobacco in the stream ahead of said first portion of said path, means for comparing the thus ascertained quantity with a preselected quantity, and means for changing the rate of transport of tobacco along said path when the ascertained quantity deviates from said preselected quantity, said ascertaining means comprising a weighing device.

* * * * *